US005725188A

United States Patent [19]

Monteiro, Jr.

[11] Patent Number: 5,725,188

[45] Date of Patent: Mar. 10, 1998

[54] LAWN CHAIR LEVELING BLOCK

[76] Inventor: Manuel D. Monteiro, Jr., P.O. Box 928, Hyannis, Mass. 02601-0928

[21] Appl. No.: 572,734

[22] Filed: Dec. 14, 1995

[51] Int. Cl.[6] ..... F16M 11/24

[52] U.S. Cl. ..... 248/188.4; 248/501

[58] Field of Search ..... 248/188.4, 346.01, 248/346.03, 346.05, 512, 513, 523, 524, 501, 502; 108/25, 28, 65, 157, 158, 149, 144; 297/130, 133, 217.7

[56] References Cited

U.S. PATENT DOCUMENTS

| | | | |
|---|---|---|---|
| 138,826 | 5/1873 | Welsh | 297/133 |
| 4,036,465 | 7/1977 | Kellner . | |
| 4,079,991 | 3/1978 | Harris | 297/133 |
| 4,117,999 | 10/1978 | Gessler . | |
| 4,494,755 | 1/1985 | Caillouet, Jr. | 248/346.03 X |
| 4,545,554 | 10/1985 | Latino et al. | 248/188.4 X |
| 4,720,140 | 1/1988 | Change, III | 297/217.7 |
| 4,867,505 | 9/1989 | Parker . | |
| 5,244,249 | 9/1993 | Tseng . | |
| 5,332,182 | 7/1994 | Weisz | 248/188.4 |
| 5,364,163 | 11/1994 | Hardison . | |
| 5,427,342 | 6/1995 | Gagnon | 248/346.03 X |
| 5,494,333 | 2/1996 | Wilson | 297/344.18 |
| 5,513,900 | 5/1996 | Iglesias | 248/501 X |

FOREIGN PATENT DOCUMENTS

| | | | |
|---|---|---|---|
| 686877 | 2/1953 | United Kingdom | 248/346.03 |

*Primary Examiner*—Leslie A. Braun
*Assistant Examiner*—Gwendolyn W. Baxter
*Attorney, Agent, or Firm*—Richard P. Crowley

[57] ABSTRACT

A lawn chair leveling block includes a portable rigid, flat ground-engaging pad designed to support the lawn chair in a level position on a sloped ground surface. The pad is provided with an upstanding elevation block having a deep groove along a top surface, and the groove is designed to cradle a U-shaped leg of the chair. Blind holes positioned in the pad at opposite ends of the elevation block are designed to support individual tubular, vertical chair legs. In addition to being utilized for leveling a lawn chair on a sloped surface, the block prevents a chair leg from sinking into soft soil so as to eliminate the risk of the chair tipping over.

9 Claims, 5 Drawing Sheets

LAWN CHAIR LEVELING BLOCK

BACKGROUND OF THE INVENTION

1. Field of the Invention

The present invention relates to chair leveling devices and more particularly pertains to a portable leveling device particularly designed for use with lawn chairs.

2. Description of the Prior Art

The use of various types of leveling devices for chairs is known in the prior art. This is evidenced by the granting of a number of patents relating to various functional and structural aspects of such leveling devices. Typically, these leveling devices comprise the use of individually adjustable length legs, and a good example of such a leveling device is to be found in U.S. Pat. No. 5,364,163 which issued to Hardison on Nov. 15, 1994. The invention shown in this patent comprises a fishing chair having two U-shaped legs with the rear leg structure being selectively adjustable in length so as to effect a desired leveling of the chair on a sloped ground surface.

The Hardison patent is representative of a number of patents which are available and which individually disclose leveling devices directly attached to or associated with a chair. However, there are apparently no commercially available leveling devices which are of a portable construction and which can be utilized with a plurality of different chairs. As such, there still exists the need for these types of portable leveling devices and in this respect, the present invention substantially fulfills this need.

SUMMARY OF THE INVENTION

In view of the foregoing disadvantages inherent in the known types of chair leveling devices now present in the prior art, the present invention provides a new chair leveling device wherein the same can be utilized to provide for a level support of a lawn chair on a sloped ground surface. As such, the general purpose of the present invention, which will be described subsequently in greater detail, is to provide a lawn chair leveling block and method which has many of the advantages of the chair leveling devices mentioned heretofore and many additional novel features that result in a chair leveling device which is not anticipated, rendered obvious, suggested, or even implied by any of the prior art chair leveling devices, either alone or in any combination thereof.

To attain this, the present invention generally comprises a lawn chair leveling block which includes a portable rigid, flat ground-engaging pad designed to support the lawn chair in a level position on a sloped ground surface. The pad is provided with an upstanding elevation block having a deep groove along a top surface, and the groove is designed to cradle a U-shaped leg of the chair. Blind holes positioned in the pad at opposite ends of the elevation block are designed to support individual tubular, vertical chair legs. In addition to being utilized for leveling a lawn chair on a sloped surface, the block prevents a chair leg from sinking into soft soil so as to eliminate the risk of the chair tipping over.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chair leveling device and method which has many of the advantages of the chair leveling devices mentioned heretofore and many novel features that result in a chair leveling device which is not anticipated, rendered obvious, suggested, or even implied by any of the prior art chair leveling devices, either alone or in any combination thereof.

It is another object of the present invention to provide a new chair leveling device which may be easily and efficiently manufactured and marketed.

It is a further object of the present invention to provide a new chair leveling device which is of a durable and reliable construction.

An even further object of the present invention is to provide a new chair leveling device which is susceptible of a low cost of manufacture with regard to both materials and labor, and which accordingly is then susceptible of low prices of sale to the consuming public, thereby making such chair leveling device economically available to the buying public.

Still yet another object of the present invention is to provide a new chair leveling device which provides in the apparatuses and methods of the prior art some of the advantages thereof, while simultaneously overcoming some of the disadvantages normally associated therewith.

Still another object of the present invention is to provide a new and improved chair leveling device which facilitates the use of a portable support pad designed to receive either U-shaped or vertical tubular legs normally associated with a conventional lawn chair.

Yet another object of the present invention is to provide a new and improved chair leveling device which is of a portable construction and which can be utilized with different sizes of lawn chairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENTS

Figure 1:
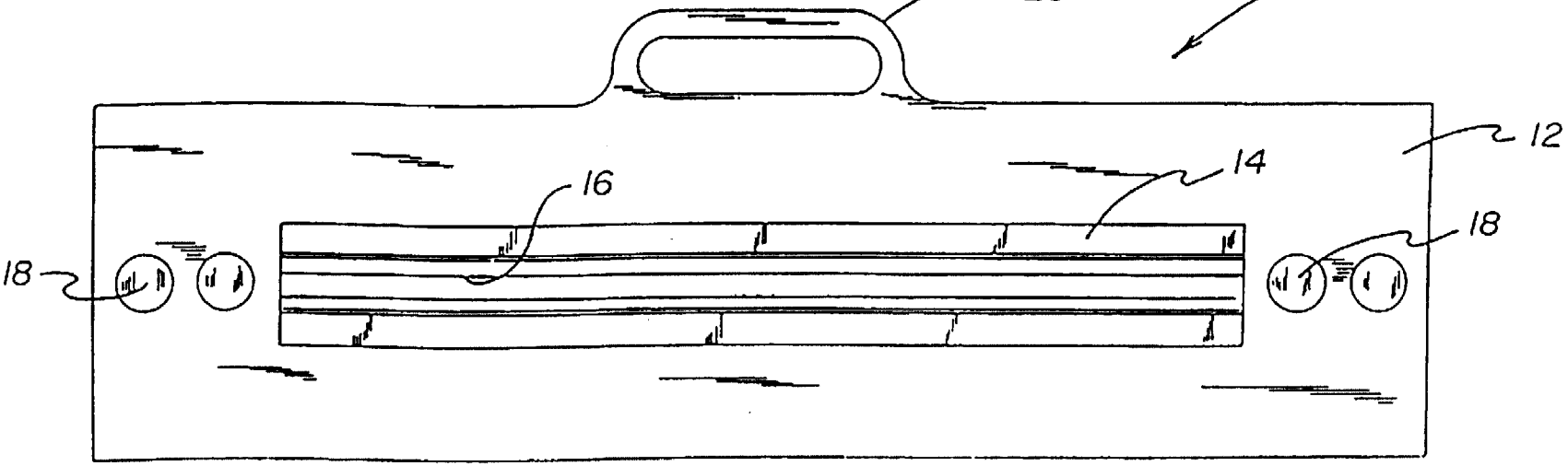
FIG. 1 is a top plan view of the lawn chair leveling block comprising the present invention.
Figure 2:
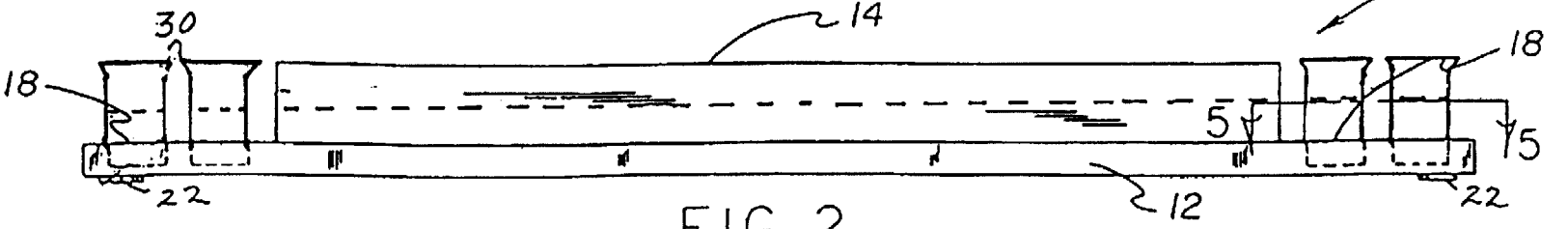
FIG. 2 is a front elevation view thereof.
Figure 3:
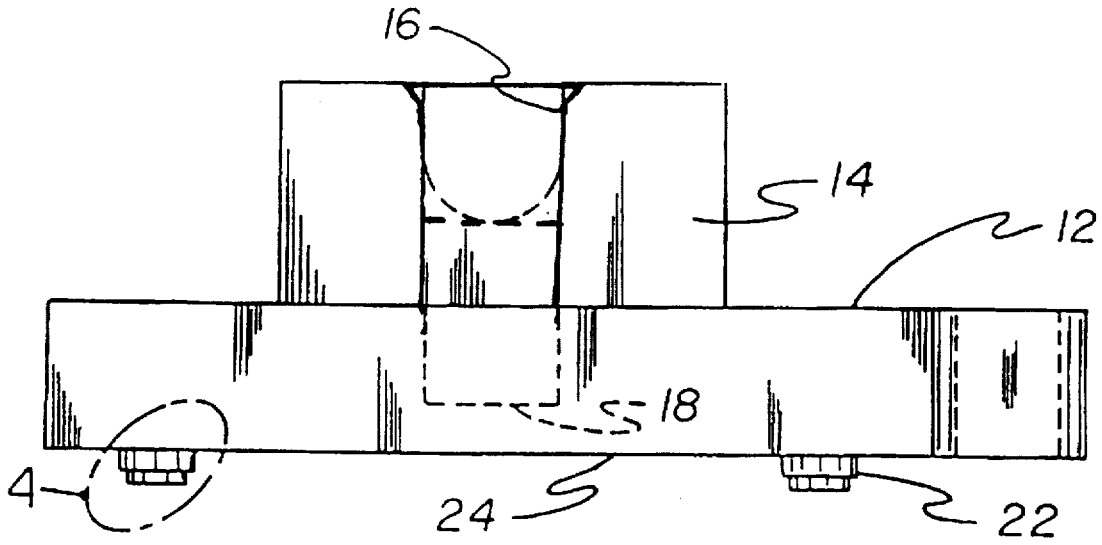
FIG. 3 is an end elevation view thereof.

With reference now to the drawings, and in particular to FIGS. 1–3 thereof, a new chair leveling device embodying the principles and concepts of the present invention and generally designated by the reference numeral 10 will be described.

More specifically, it will be noted that the lawn chair leveling block 10 essentially consists of a molded plastic support pad 12 which is of a rectangular flat construction so as to prevent it from being easily flipped over. The support pad 12 is provided with an upstanding elevation block 14 positioned along a top surface thereof, and the elevation block is provided with an elongated groove 16 along its entire axial length.

A plurality of blind holes, each of which is generally designated by the reference numeral 18, are formed in a top surface of the support pad 12. These holes 18, which do not extend completely through the support pad 12, are in an aligned relationship with the elevation block 14 and are disposed at opposite ends thereof. Holes 18 must be the same level as elevation block 14 and should be the same depth as elongated groove 16.

Figure 4:
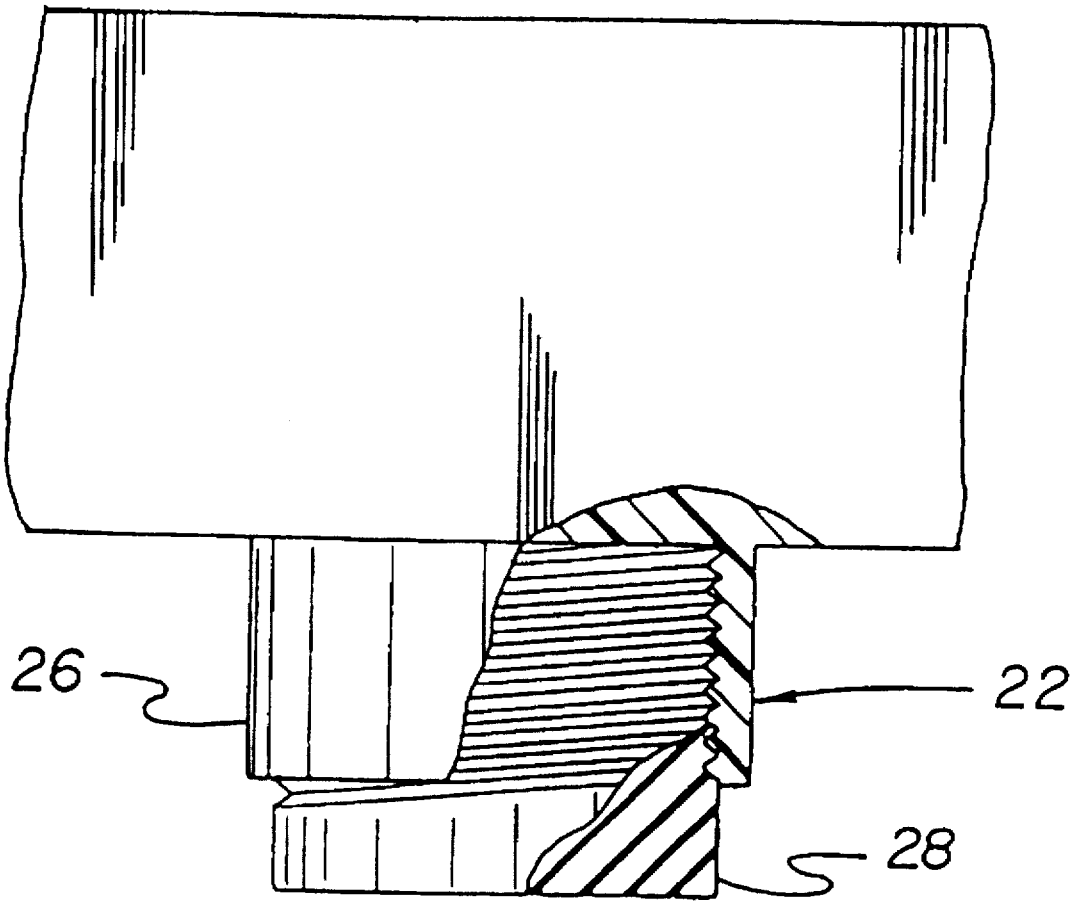
FIG. 4 is an enlarged detail view taken from FIG. 3 of the drawings.

The leveling block 10 may also optionally include a molded handle 20 to facilitate a transporting of the block to a desired location in a convenient manner. Additionally, a plurality of elevation adjusting legs 22 may be integrally or otherwise fixedly secured to a bottom surface 24 of the support pad 12. The elevation adjusting legs 22, as best illustrated in FIG. 4, may include an integral internally threaded cylindrical member 26 into which an externally threaded cylindrically-shaped leg member 28 may be positioned. As can now be appreciated, a simple manual rotation of the leg member 28 is all that is required to threadably increase or decrease the length of the leg assembly 22, thereby to achieve the desired leveling of the lawn chair leveling block 10.

Figure 5:
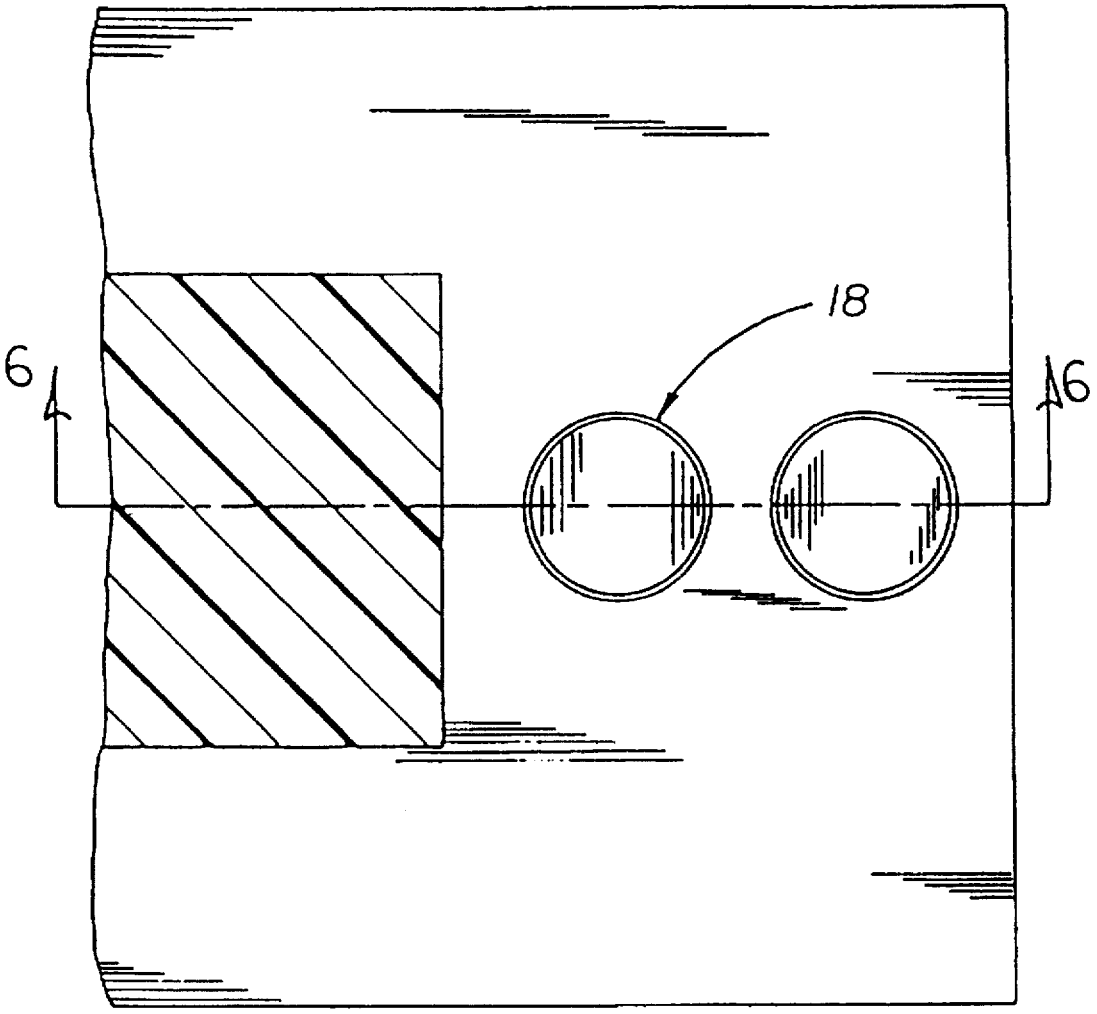
FIG. 5 is a cross-sectional view of the invention as viewed along the line 5—5 in FIG. 2.
Figure 6:
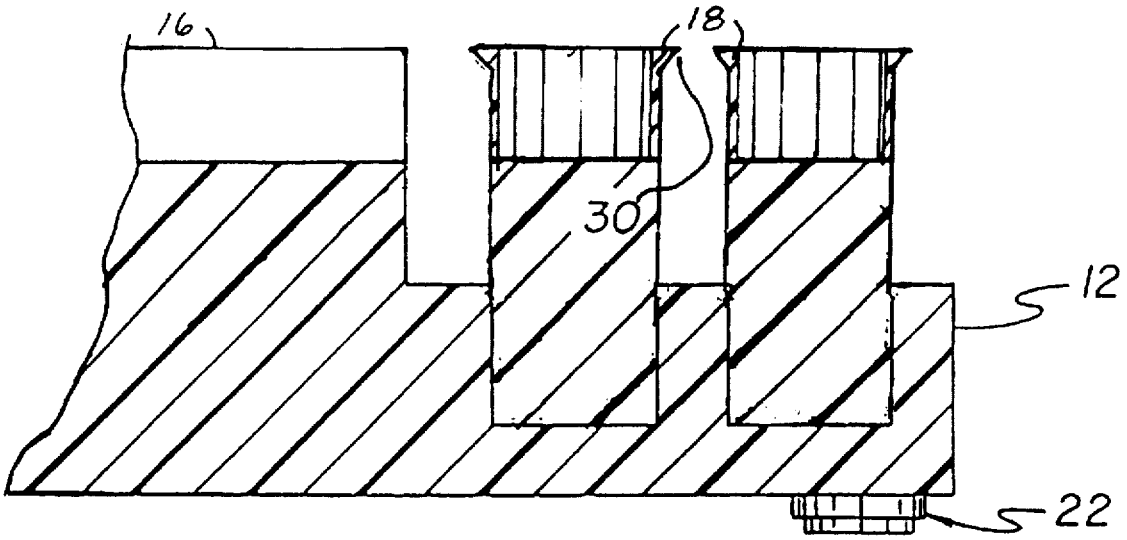
FIG. 6 is a cross-sectional view of the invention as viewed along the line 6—6 in FIG. 5.

FIGS. 5 and 6 more particularly illustrate the design of the blind holes 18. In this regard, it can be seen that each hole 18 extends only partially through the support pad 12 and is provided with an upper bevelled circular edge 30 whereby the top of each hole is of a slightly increased diameter to facilitate an initial positioning and receiving of a vertical tubular leg associated with a lawn chair.

As to a further discussion of the manner of usage and operation of the present invention, the same should be apparent from the above description. In this regard, it can be appreciated that sitting on a sloped surface in a lawn chair is quite uncomfortable, and it frequently places a strain on the abdomen or back muscles of the person utilizing the chair. Being pitched back is equally uncomfortable because the center of gravity is offset from the normal position, and the lawn chair leveling block 10 comprising the present invention can be utilized to eliminate these problems. The block 10 can be carried along with a lawn chair, and the colors of the blocks can match those of a chair if that is important to an individual. In utilizing the block 10, a chair is initially placed in a location that has a slope which matches the elevation provided by the block. This is accomplished by placing the block 10 under the legs of the chair and observing that the chair seat is level rather than tilted. In most cases, the block 10 will be placed under the front U-shaped leg of a lawn chair so as to accommodate a down slope. In this situation, the U-shaped leg will be securely positioned in the elongated groove 16. On those occasions where it may be necessary to face uphill, the block 10 can be positioned under one or both of the vertical tubular rear legs associated with the lawn chair, and the vertical legs are positionable in one or more of the blind holes 18. Inasmuch as lawn chairs come in slightly variable widths, whereby the vertical tubular legs may be spaced apart in different amounts, the use of a plurality of aligned holes 18 accommodates these spacing variations. The elongated groove 16 is open at opposed ends within the elevation block 14 and is therefore already capable of accommodating any width of U-shaped leg.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable leveler and stabilizer for a lawn chair having a continuous U-shaped leg frame, which leveler and stabilizer comprises:

a) an elongated support pad for leveling and supporting said lawn chair on a ground surface and having a top surface and a bottom surface;

b) an elongated U-shaped axial groove formed in the top surface of the support pad, the groove having a depth and width designed and sufficient to receive and cradle directly therein the U-shaped leg frame of the lawn chair; and c) the support pad characterized by at least one blind circular hole at each end of said groove, and having a depth substantially the same as the depth of said groove, the blind holes axially aligned with the axis of said groove, and each blind hole designed to receive and support therein, where required, at least one end of a vertical leg of said lawn chair to accommodate lawn chairs of variable width in the vertical legs.

2. The leveler and stabilizer of claim 1 which includes adjustable support pad leveling means on the bottom surface to permit leveling of the support pad.

3. The leveler and stabilizer of claim 1 wherein a support pad leveling means comprises a plurality of spaced-apart, threadably extendable legs mounted on the bottom surface of the support pad.

4. The leveler and stabilizer of claim 1 wherein said support pad includes an elongated elevation block having a block surface and a one and the other end and fixedly secured to the said top surface of the support pad, and the said elongated groove formed and extending in the block surface along the entire axial length of the elevation block.

5. The leveler and stabilizer of claim 1 wherein the support pad includes a handle to facilitate transporting of the leveler and stabilizer.

6. The leveler and stabilizer of claim 1 which includes a plurality of spaced-apart, blind, circular, aligned holes at each end of the elongated groove.

7. The leveler and stabilizer of claim 1 wherein said at least one blind hole has a bevelled inward circular top edge to facilitate reception of a vertical leg.

8. A portable leveler and stabilizer for a lawn chair having a continuous U-shaped leg frame or vertical tubular legs or a combination thereof, which leveler and stabilizer comprises:

a) an elongated support pad for leveling and supporting said lawn chair on a ground surface and a flat bottom surface;

b) an elongated elevation block having a top block surface and a bottom surface fixedly secured to the top surface of the support pad;

c) an elongated axial groove formed in the top surface of the elevation block, said groove having generally a U-shape and of a depth and width sufficient to receive and cradle the U-shaped leg frame of said lawn chair, the groove extending along the entire length and to each end of the elevation block; and d) the support pad characterized by a plurality of circular blind holes at each end of said groove, each hole adapted to receive and support therein a vertical leg of said lawn chair, the blind holes having a depth substantially the same as the depth of said groove, and said blind holes axially aligned with the axis of said groove.

9. A portable leveler and stabilizer for a lawn chair having a continuous U-shaped leg or a pair of vertical tubular legs or a combination thereof, which leveler and stabilizer comprises:

a) an elongated support pad having a top surface and a flat bottom surface, the support pad for leveling and supporting said lawn chair on a ground surface;

b) an elongated, generally centrally positioned elevation block of defined length fixedly secured to the top surface of the support pad and having a top block surface;

c) said elevation block characterized by a formed elongated axial U-shaped groove of defined depth and width in the top block surface and designed to receive and cradle therein the U-shaped leg frame of said lawn chair, said groove extending the entire length of said elevation block; and d) a plurality of blind holes at each of said block, the depth of the holes substantially the same as the depth of the U-shaped groove and designed to receive in the blind holes vertical leg frames of said lawn chair and the center of said blind holes axially aligned with axis of said grooves.

* * * * *